US005511621A

United States Patent [19]

Yao

[11] Patent Number: 5,511,621

[45] Date of Patent: Apr. 30, 1996

[54] LOCAL FLOODING FINE WATER SPRAY FIRE SUPPRESSION SYSTEM USING RECIRCULATION PRINCIPLES

[75] Inventor: Cheng Yao, Weston, Mass.

[73] Assignee: Factory Mutual research, Mass.

[21] Appl. No.: 225,317

[22] Filed: Apr. 8, 1994

[51] Int. Cl.[6] ..... A62C 35/00

[52] U.S. Cl. ..... 169/17; 169/46

[58] Field of Search ..... 169/43, 46, 47, 169/54, 56, 57, 60, 5, 16, 17, 18, 19, 37, 38–41

[56] References Cited

U.S. PATENT DOCUMENTS

| | | | |
|---|---|---|---|
| 2,498,512 | 2/1950 | Thompson | 169/12 |
| 3,033,292 | 5/1962 | Browning | 169/2 |
| 3,301,485 | 1/1967 | Tropeano et al. | 239/2 |
| 3,407,880 | 10/1968 | Davis | 169/12 |
| 3,692,118 | 9/1972 | Yao | 169/1 A |
| 3,708,015 | 1/1973 | Yao | 169/12 |
| 3,722,596 | 3/1973 | Livingston | 169/1 A |
| 3,743,022 | 7/1973 | Livingston | 169/16 |
| 3,759,331 | 9/1973 | Livingston | 169/17 |
| 3,780,811 | 12/1973 | Yao | 169/46 |
| 3,812,915 | 5/1974 | Livingston | 169/1 A |
| 3,826,313 | 7/1974 | Yao | 169/44 |
| 4,359,097 | 11/1982 | Claussen | 169/61 |
| 4,474,680 | 10/1984 | Kroll | 252/307 |

*Primary Examiner*—Jesus D. Sotelo
*Attorney, Agent, or Firm*—Lane, Aitken & McCann

[57] ABSTRACT

In a fire extinguishment system, aspiration type fine water spray nozzles are distributed under the ceiling of a structure to be protected. The nozzles contain venturi housings to draw combustion gases from under the ceiling and to discharge combustion gases along with steam and mist downwardly from the nozzles. The discharge from the lower end of the venturi housing is delayed by twirlers sufficiently for the water droplets sprayed within the housing to be converted to steam. The steam and combustion products provide a localized flooding effect to extinguish the fire. The water is supplied to the nozzles in a dry pipe system wherein the discharge of water in the nozzles over a fire is delayed sufficiently for at least one to two rows of nozzles (4 to 12) around the fire to be actuated. In this manner, a vortex is achieved wherein the upward thrust of the fire plume is balanced by the downward jetting action of the steam mist and combustion products to achieve an effective curtain to prevent ambient air from reaching the fire.

11 Claims, 3 Drawing Sheets

LOCAL FLOODING FINE WATER SPRAY FIRE SUPPRESSION SYSTEM USING RECIRCULATION PRINCIPLES

This invention relates to an improved water base fire suppression system.

Fire extinguishment with extinguishing agents can be accomplished by essentially three different processes. (1) cooling the surface of the solid combustibles providing fuel to the fire, (2) cooling the flame, or (3) inhibiting or smothering the fire by inerting the incoming air. As a local application system, sprinklers suppress fire usually by cooling the combustible surface with water delivered, only from sprinklers that were actuated around the fire area, onto the top surface of the combustible material fueling the fire. Major drawbacks of the sprinkler systems are their inefficient use of water resulting in an enlarged volume of run-off and their ineffectiveness in protecting flammable liquid fires. As a result, Halon 1301 has been a popular extinguishing agent which is used as a total flooding gaseous agent to put out flammable liquid fires by filling the entire building volume with Halon at about 7–10% concentration. Because Halon 1301 is gas, it is able to flow around obstacles to reach a fire emanating from a hidden surface and retains its effectiveness for a long period in an enclosed space. However, Halon 1301 is rapidly being phased out because of environmental considerations and this fact has resulted in a desperate search for alternatives. Fine water spray, sometimes known as a water mist, fog or high pressure spray, has been a prominent candidate to replace the Halon 1301 as the extinguishing agent in fire suppression systems. Most commercial fine water spray systems delivers water through a nozzle under high pressure or by an atomization to produce small droplets in the range of thirty to three hundred microns in size. These systems, however, are not as effective in flooding a fire as Halon gas because the droplets have a limited suspension time and a terminal velocity which determines whether the droplet will separate from the main flow stream when it moves around obstacles to reach fire on hidden surfaces. In addition, commercial fine water spray systems do not retain their effectiveness without continuous water discharge from the nozzles. Most commercial fine spray systems fail to extinguish a fire if the sprays are not applied directly onto the combustion volume. In order for water to be a true flooding agent, it must be delivered to the building volume in the form of steam or fine mist of micron sized particles and the steam and fine mist must be maintained in the building at a high concentration in the range of a mass fraction of 20–40 percent. Commercial fine spray systems fail to make use of steam in this manner.

The present invention relates to a fixed, local flooding, fine water spray fire suppression system which makes use of an aspiration or venturi type nozzles which are distributed under the ceiling of a large building or enclosure over the area to be protected in a similar manner as a sprinkler system. The aspiration type nozzle has two openings, an inlet opening at the top and a discharge opening at the bottom of the nozzle. The inlet opening receives the hot fire gas consisting of combustion products and water vapor flowing outwardly from the fire axis under the ceiling. This hot fire gas flowing outward from the fire axis under the ceiling is commonly referred to as ceiling flow. The nozzle of the invention is like that described in the fire suppression system disclosed in the prior art U.S. Pat. No. 3,692,118 to Cheng Yao and the present invention is an improvement over the system described in this patent. In the system of U.S. Pat. No. 3,692,118, the nozzles are intended to recirculate the combustion products to set up a vortex flow around the fire and provide a barrier to incoming air from reaching the fire. As a result, the fire is supposed to be smothered by the inert atmosphere of the vortex comprising the combustion products from the fire mixed with the fire extinguishing agent supplied by the nozzles.

In practice, the system of U.S. Pat. No. 3,692,118 sometimes fails to provide the intended vortex barrier. For example, when fire is ignited under the center of four nozzles, one or two nozzles closest to the fire may get actuated first and begin supplying water droplets to the fire in an unsymmetrical manner. As a result, the droplets discharged from these nozzles have the effect of cooling the flame and preventing actuation of the third and fourth nozzles in the first ring, or nozzles further removed from the fire. As a result, the few nozzles actuated initially can only provide an insufficient or partial barrier. As a result, the fire suppression performance will be ineffective and the fire will continue to spread and intensity before actuation of additional nozzles to set up the vortex around the fire.

SUMMARY OF THE INVENTION

In accordance with the present invention, these problems with the prior art system described in U.S. Pat. No. 3,692,118 are avoided by providing a system in which the discharge of water from the nozzles over the fire is delayed so that at least one and preferably two rings of nozzles around the fire become actuated. The phrase "ring of nozzles" as used herein means at least four nozzles uniformly distributed around an axis approximately equidistant from the axis. The number and distribution of the nozzles should be sufficient to generate an effective barrier to ambient air. By delaying the actuation until at least two rings of nozzles are actuated, a proper balance between the upward thrust of the force of the fire plume and the downward thrust and jetting action of the nozzles achieves a sufficient vortex flow around the fire to ensure that an effective barrier to ambient air is provided. In addition, the nozzles are provided with twirlers in the venturi sections of the nozzles to enhance the heat transfer between the hot fire gas and water droplets and to delay the exit of the mixture from the nozzles until the water droplets have been substantially converted to steam and fine mist. As a result, the vortex created by the system is an inert atmosphere of combustion products from the fire, steam, and fine mist. Because the steam and mist, which comprise 20–40% of the inert atmosphere, behave in the vortex almost like gas, they are very efficient in completely flooding the area of the fire in the vortex and, along with the combustion products in the vortex which are also gases, they very efficiently smother the fire.

In order to assure that a group of nozzles discharge water simultaneously around the fire to set up the desired vortex motion, a dry pipe system is employed. In a dry pipe system, air or gas at a high pressure is provided in connecting piping between the nozzles and a dry pipe valve in a riser or water main. When a nozzle opens in response to the rise in temperature from the fire, it does not immediately begin to discharge water because the dry pipe valve supplying water to the connecting piping does not open immediately. Before the valve can open and begin supplying water to the connecting piping, the high pressure in the connecting piping must be bled off through the nozzle or nozzles which are actuated adjacent to the fire. The valve is maintained closed by the high pressure in the connecting piping and opens in response to the pressure dropping to a low value. When the pressure in the connecting piping has dropped to a low enough value, the valve supplying water to the piping will open and the actuated nozzles will begin discharging water. In this manner, the discharge of water in the nozzles adjacent to the fire is delayed until one or two rings of nozzles around the fire actuated so that a sufficient number of nozzles become actuated to generate an effective inerting vortex barrier around the fire.

DESCRIPTION OF THE PREFERRED EMBODIMENT

Figure 1:
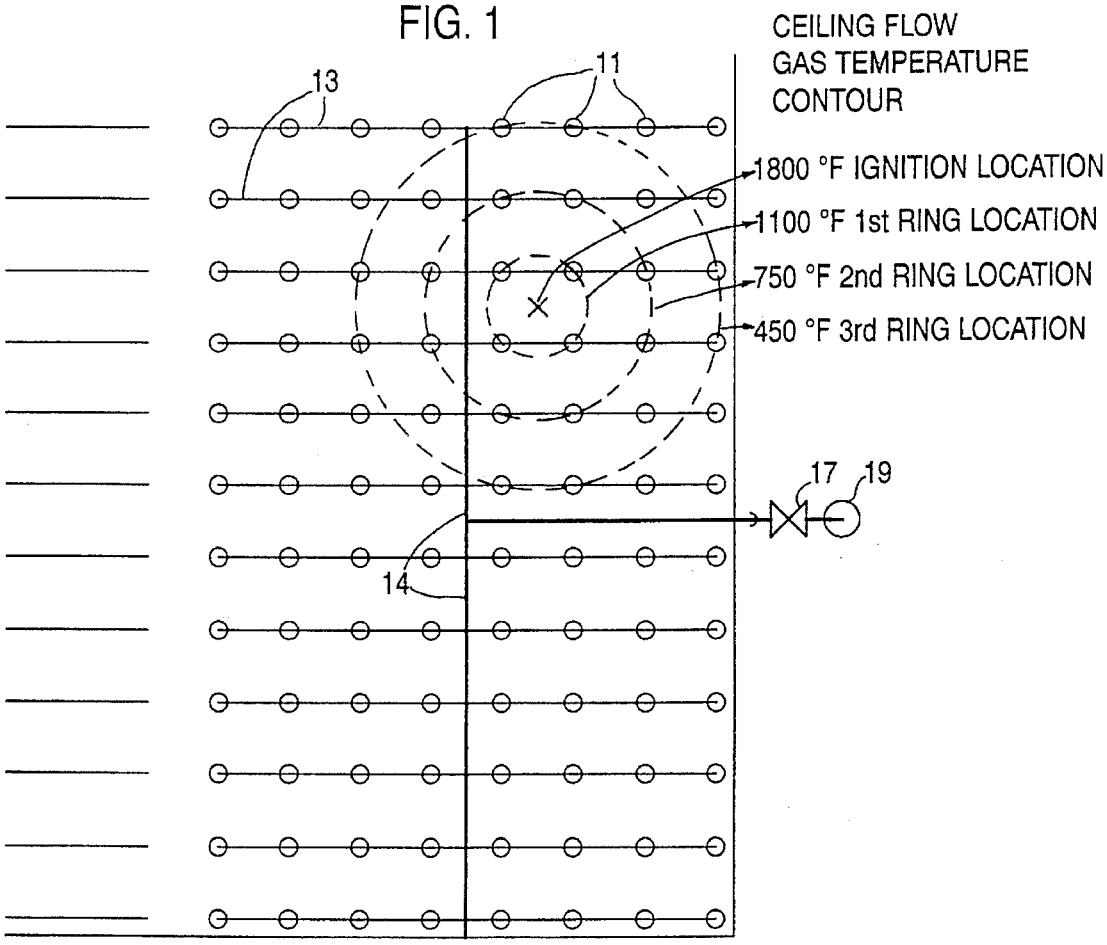
FIG. 1 schematically illustrates a top plane view of the system of the invention. It also shows the temperature contours of the ceiling flow of fire gases, passing the first second and third sprinkler ring locations at the time of the second ring nozzle operation.
Figure 2:
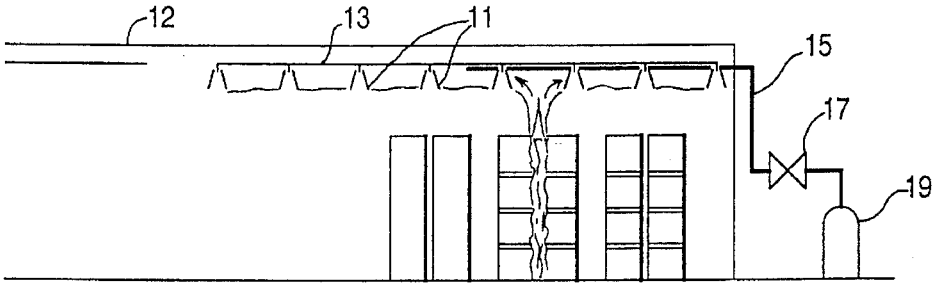
FIG. 2 is a schematic view in elevation of the system of FIG. 1.

As shown in FIGS. 1 and 2, the system of the invention comprises a set of aspiration nozzles 11 distributed throughout the protected area at fixed intervals, such as 10 by 10 foot intervals, and positioned under the ceiling 12 sheltering the protected area. The nozzles 11 are connected by branch-lines 13 and cross-main 14 to a riser 15 containing a dry pipe valve 17. The branch-lines 13 are provided in a center-central feed system wherein the branch pipes on which the nozzles are mounted are connected to the cross-main pipe extending across the center of the branch lines. The riser 15 connects to a water main supply 19 which provides water at a high pressure of 200 to 1000 psi needed to achieve fine water spray in the nozzles. The air or gas in the connecting piping between the dry pipe valve 17 and the nozzles 11 will be at 20 psi in excess of the calculated trip pressure of the dry pipe valve based on the water pressure of the system supply to have the dry pipe valve 17 closed. The dry pipe valve trip pressure, however, is normally designed to be at much lower value than the water pressure by means of pressure differential actuation design. The aspiration nozzles 11 in the preferred embodiment are activated in response to the temperature rising of the flowing fire gas passing the nozzle locations to a predetermined value resulting from the presence of fire below the activated nozzles. As a result, when a fire occurs, the nozzle directly over or directly adjacent to a fire will be opened and the air or gas within the connecting piping will begin to flow out of the open nozzle reducing the pressure in the connecting piping. When the air pressure in the connecting piping has dropped to the trip value of the dry pipe valve 17, the dry pipe valve 17 will respond by opening and supplying water to the connecting piping. In this manner, the flow of water to the activated nozzles is delayed. During the delay period, before water begins to flow out through the initially actuated nozzles, the fire will build in intensity and causing faster actuation of additional nozzles in comparison with the cases of immediate discharge of water from the first few nozzles nearest the fire. In accordance with the invention, the system is designed to cause a sufficient delay before water begins to flow through the actuated nozzles so that at least one, and preferably two, rings of nozzles or 4 to 12 nozzles in a circular array of nozzles surrounding the fire are actuated. This operation of the system will have the effect of more effectively extinguishing the fire as will be explained below. On the other hand, the delay in the water discharge should not be too great to cause too many nozzles to be actuated. The number of actuated nozzles as the water begins to discharge from the nozzle should not be greater than 24 and preferably should not exceed 16. Ceiling flow fire gas temperature is highest and most concentrated with combustion products over the area projected above the 12 operative nozzles.

Instead of using the dry pipe system to provide the delay, an electrically actuated valve in the riser could be employed and the delay to the actuation of the valve 17 could be provided electronically.

The nozzles employed in the system are fine water spray nozzles of the aspiration type which, upon being actuated, discharge a flow of water in a fine water spray from inner nozzle units and draw hot fire gases at the temperature of 500°–1000° from above the nozzles through venturi housings surrounding the inner nozzle units to convert effectively the water spray to steam and fine mist, which are projected downwardly from the nozzles. These nozzles are similar to the nozzles described in U.S. Pat. No. 3,780,811 and 3,692,118 and an example of such a nozzle is shown in FIG. 4.

Figure 4:
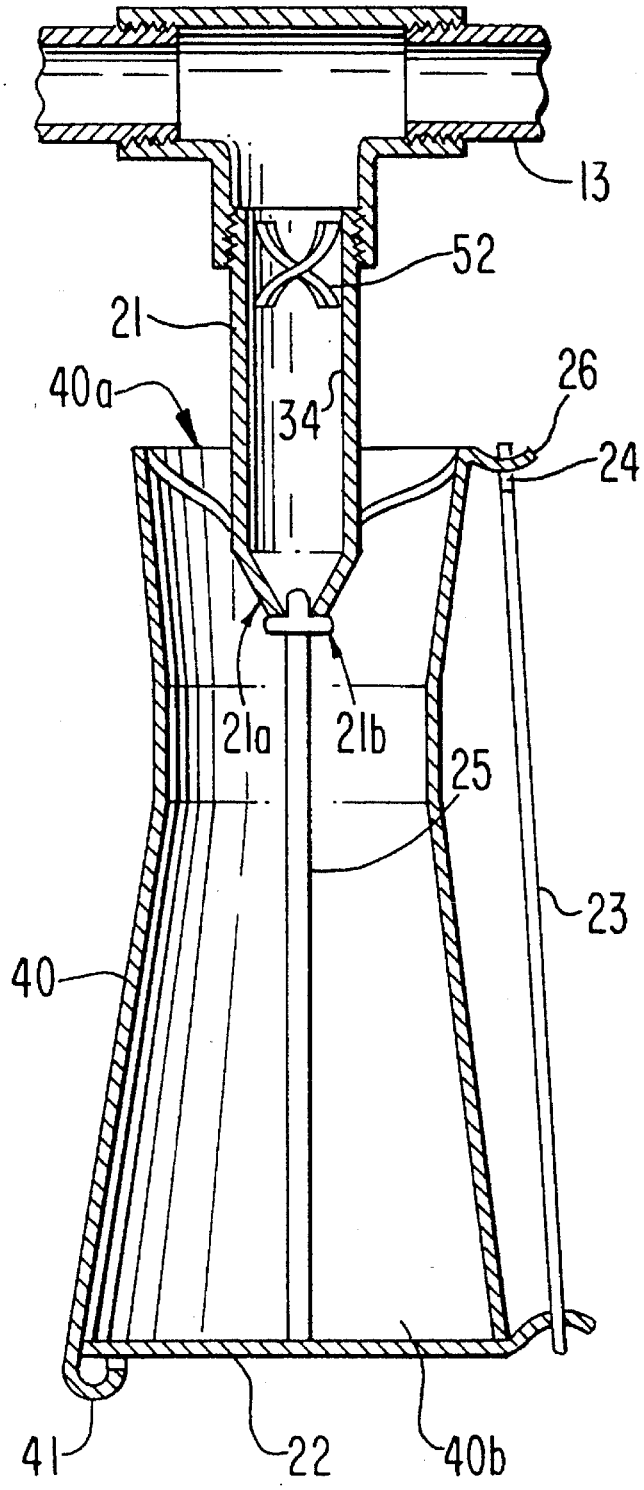
FIG. 4 is a sectional view illustrating an aspiration nozzle used in the system of the present invention.

As shown in FIG. 4, the nozzle used in the system of the invention includes an inner nozzle unit 21 defining a fine water spray discharge outlet 21*a* at its lower end surrounded by a venturi housing 40. One end of the nozzle 21 is connected to a branch line for receiving water. A valve seat 21*b* is formed at the discharge outlet 21*a* in a conventional manner to control the discharge of air and water through the nozzle. A rod 25 has one end connected to the valve seat 21*b* and extends for the entire length of the venturi housing 40 to engage a lever 22 extending across the lower end of the housing 40. One end of the lever 22 is pivotally mounted to a crimped portion 41 of the housing 40. The other end of the lever 22 extends through a slot in the housing rim and is connected through a connecting link 23 to one side to a fusible link 24. The other side of the fusible link 24 is attached to an arm 26, which is fixed to the top of the housing 40. The venturi housing 40 is formed in the shape of a venturi and extends from an inlet end 40a above the discharge outlet of the nozzle unit 21 to below the discharge outlet of the nozzle unit 21. Two twirlers 52 and 53 are mounted in the nozzle 21 and venturi housing 40, respectively, to enhance the vaporization process and to delay the discharge of the mixture of combustion products, steam and mist from the housing 40. The housing 40 is mounted on the nozzle 21 by means of the twirler 53.

In operation, when a fire has occurred below the nozzle, the temperature at the fusible link 24, as shown in FIG. 4, will rise to a value to cause the fusible link to fuse and come apart. When the fusible link 24 comes apart, the arm 22 will pivot under the force of the valve stem 25 as a result of gas pressure in the connecting piping 13 and acting against the valve head 21b. As a result, the valve head unseats from the nozzle outlet 21*a* and the gas in the connecting piping begins to flow through the nozzle unit 21 to reduce the pressure in the connecting piping 13 as described above. When the pressure has been reduced to the trip value of the dry pipe valve, the dry pipe valve will open and water will flow through the connecting piping and be sprayed in a fine spray out through the nozzle unit 21 into the venturi housing 40. The velocity of the spray coming out of the nozzle unit 21 will create an aspiration effect which will draw the hot fire gases flowing under the ceiling through the inlet 40*a*. The twirler 53 will increase the residence time of the fire gases in the housing 40 and this action along with the swirling fine spray water droplets due to the action of twirler 52 in the nozzle 21, will allow a sufficiently long residence interval for the water droplets to be either reduced in size and partially converted to steam or completely converted to steam. Thus, the fluid projected downwardly from the discharge opening **40*b* of the housing 40** will be a mixture of steam, fine water mist, and combustion products, which will have the capability of flooding the fire zone and smother the fire.

Figure 3:
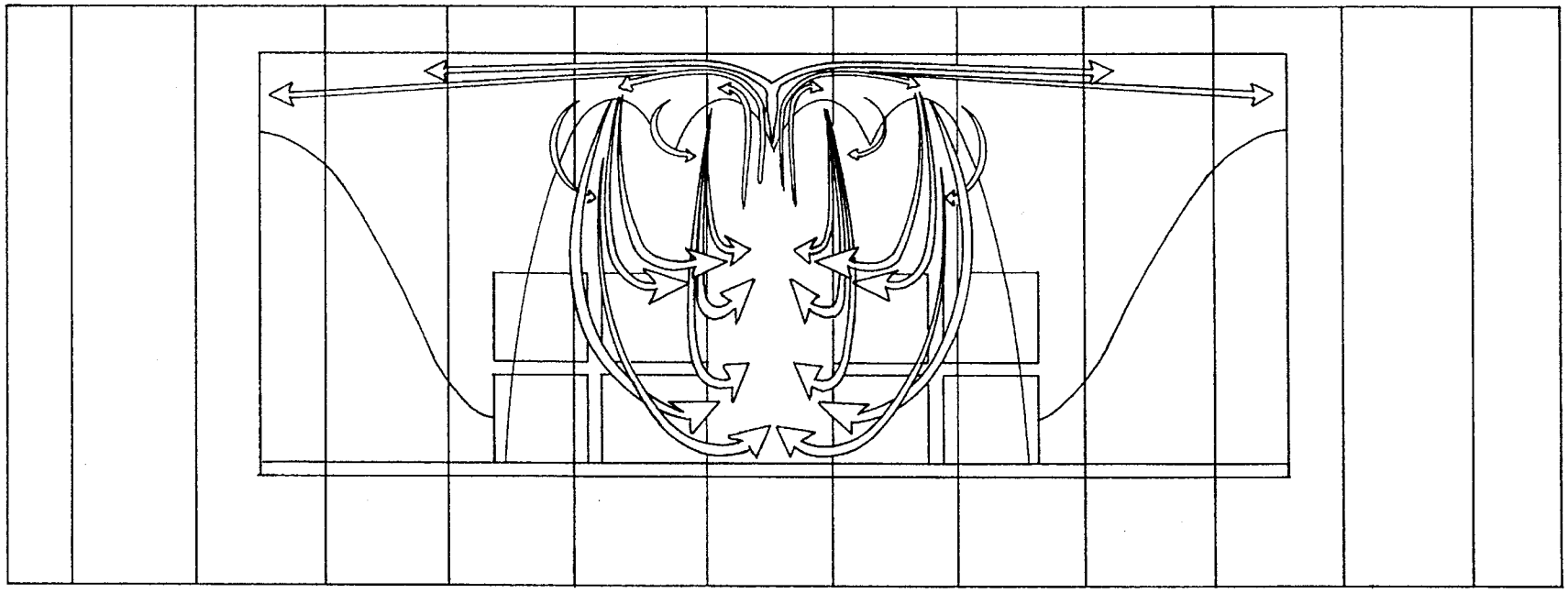
FIG. 3 illustrates the system of the invention in operation generating the vortex barrier to smother the fire.

As explained above, the discharge of water from nozzles over the fire is delayed sufficiently so that preferably at least two rings of nozzles surrounding the fire are actuated and spray water at the time shortly after the water flow begins. By delaying the initiation of the water spray until two rings of nozzles become actuated, a proper balance between the upward thrust force of the buoyant fire plume and downward drawing and jetting action is achieved resulting in the formation of a recirculating vortex of steam, water mist, and combustion products surrounding the fire, wherein the steam, water mist, and combustion products flow downwardly in a barrier curtain completely surrounding the fire and are recirculated upwardly by the fire plume as shown in FIG. 3. In this manner, the vortex provides an effective barrier to incoming air from reaching the fire and the recirculation of the inert fluid with the vortex will also cause continuous build-up of the inert gas concentration around the fire zone. These effects together with the smothering effect of steam, water mist and combustion products flooding locally around the fire achieve an efficient extinguishment of the fire in a short period of time.

The delay from the time that the first nozzle opens to the time that the water be discharged from the nozzles over the fire is made up of two components, the delay up until the dry pipe valve is actuated, called the trip time, and the delay due to the time it takes the water to flow from the dry pipe valve to the actuated nozzles, called the transit time. The transit time will vary with the system feed arrangement, the volume of the connecting piping and to minimize the transit time delays and to have the overall delay between the time that the dry pipe valve is tripped and the discharge of water be substantially the same for all the nozzles in the system, the nozzles are mounted in a center-central feed system in which the cross-main pipe feeds the branch lines at a central location as shown in FIG. 1. The transit time in a fine water spray system which involves the use of high water pressures and the center-central feed system of small pipe volume can be reduced to a few seconds. The trip time delay is determined by the time it takes the pressure in the connecting piping to drop down to the trip value. The rate of change of the pressure in the connecting piping can be determined from the following equations:

$$\frac{dP_a}{dt} = \frac{P_a}{V_t}\left[-\left\{ g\gamma RT_a\left(\frac{2}{\gamma+1}\right)^{\frac{\gamma+1}{\gamma-1}}\right\}^{1/2} A_e\right]$$

for $P_\infty/P_a < 0.528$ or $$\frac{dP_a}{dt} = \frac{P_a}{V_t}\left\{-\left(\frac{2g\gamma RT_a}{\gamma-1}\right)^{1/2}[(P_\infty/P_a)^{2/\gamma} - (P_\infty/P_a)^{\gamma+1/\gamma}]^{1/2}A_e\right\}$$

for $P_\infty/P_a \geqq 0.528$.

In these equations $P_a$ and $P_\infty$ are, respectively, the air pressure in the connecting piping and in the atmosphere, $V_t$ is the total volume of the connecting piping, g is gravitional acceleration, $\gamma$ is the ratio constant, $T_a$ is the temperature of the air in the of the specific heat at constant pressure to the specific heat at constant volume, R is the gas connecting piping and $A_e$ is the discharge area of the open nozzles. By integrating the above equation, the time it takes the pressure in the connecting piping to drop to the trip value and, thus, the trip time can be calculated. The above equations show that the trip time is increased with the air pressure Pa and the pipe volume $V_t$. A typical extra-hazard dry pipe sprinkler system has a water pressure of 100 psi and pipe volume of 500–1000 gallons. The system of this invention uses water at the initial pressure of 200 to 1000 psi and a pipe volume of 20 to 100 gallons, and thus provides a much shorter trip time than that for typical sprinkler systems.

To achieve the actuation of two rings of nozzles around a fire in a circular array of nozzles, the number of nozzles that needs to be actuated is 12 to 16. Actuating more nozzles than 16 will not interfere with the flooding effect and barrier effect of the actuated nozzles if the water pressure remains substantially unaffected. From a conservation standpoint, it is preferable to actuate no more than the number of nozzles needed to extinguish the fire. Accordingly, the preferred embodiment of the invention provides a sufficient time delay to actuate 12 to 16 nozzles over and around the fire. While a maximum of 16 nozzles is preferred, up to 24 nozzles may be actuated and effectively achieve the object of the invention and extinguish the fire with a satisfactory barrier and flooding of the ignited area.

The amount of time to actuate 12 nozzles, 16 nozzles or 24 nozzles before any water is discharged varies with the occupancy being protected by the fire extinguishment system and specifically varies with the type of fuel being burned, the height of the ceiling and the sensitivity of the nozzles being actuated. In the preferred embodiment as in most fire protection sprinkler systems or fine water spray systems, the nozzles are actuated in response to heat from the fire and the sensitivity of the heat sensing elements of the nozzles is measured by a value referred to as response time index or, more simply, as RTI. The conductivity factor C of the fusible links of the nozzles, which is a measure of how fast heat is drained from the link by the surrounding structure, will also vary the time to actuate the multiple nozzles. The amount of delay required to actuate 4, 12 to 16 nozzles and up to 24 nozzles has been determined for two center-central feed dry pipe systems to protect 15 foot high rack storage of plastic commodities under a 30 foot high ceiling. The plastic commodity consists of 16 ounce capacity polystyrene cups packaged in compartmented single wall corrugated paper cartons, each carton measuring 21 inches by 21 inches by 20 inches high and containing 125 compartments with five levels of compartments in each carton and 25 compartments on each level. In each of these determinations, the conductivity factor of the fusible links of the nozzle is assumed to be negligibly small. The temperature rating of the links is 160° F. and the RTI is specified as 54 (ft. sec.)$^{1/2}$. In each of the determinations, the nozzles are mounted in 10 foot by 10 foot arrays over the protected space with the heat sensitive links located 8 inches beneath the ceiling. The dry pipe valve used has a pressure differential ratio of 5.8 to 1.

In the first scenario, the pipe volume is 1000 gallons, the water pressure is 100 psi, the air pressure is 40 psi,and the nozzle (sprinkler) diameter is ½ inches. Under these conditions, the dry pipe valve would be tripped at 17 seconds after actuation of the first nozzle, at which time 12 nozzles would be actuated, and water would arrive at the opened nozzles after 28 seconds, at which time 16 nozzles would be actuated. With the same system, but with the air pressure reduced to 20 psi, the valve would be tripped 3 seconds after actuation of the first nozzle, and water would arrive at the opened nozzles after 14 seconds, at which time 4 nozzles would be actuated.

In a second scenario, the pipe volume is 150 gallons, the water pressure is 200 psi, the air pressure is 50 psi and the nozzle diameter is ¼ inch. Under these conditions, the dry pipe valve would be tripped 21 seconds after actuation of the first nozzle, at which time 12 nozzles would be actuated, and water would arrive at the opened nozzle after 24 seconds, with same number of opened nozzles. With the same system, but the air pressure increased to 60 psi and water pressure decreased to 150 psi, the valve would be tripped 31 seconds after actuation of the first nozzle, at which time 16 nozzles would be open, and water would arrive at the opened nozzles after 34 seconds, at which time 24 nozzles would be open.

In each of the above-identified examples, the ambient temperature was assumed to be 60 degrees F. Changing the ambient temperature to 30 degrees only marginally affects the number of nozzles actuated after the specified delays.

From the above data, the desired delay to actuate two rings of nozzles, 12 to 16 nozzles or, alternatively, two-plus rings of nozzles, 12 to 24 nozzles can be determined and the system can be adjusted so that the trip time of the dry pipe valve is selected to achieve this delay. The trip time can be adjusted either by changing the gas pressure in the connecting piping, reducing or increasing the volume of the connecting piping or changing the pressure differential value of the dry pipe valve. In this manner, a system can be constructed to achieve the result of having two rings of nozzles surrounding a fire actuated at the time water is first discharged from the actuated nozzles.

The above description is of a preferred description of the embodiment of the invention and modification may be made thereto without departing from the spirit of the invention which is defined in the appended claims.

I claim:

1. A fire extinguishment system for the extinguishment of a fire within a structure having a ceiling comprising a multiplicity of nozzles distributed over an area within said structure adjacent to and under said ceiling, each of said nozzles including means to actuate such nozzle in response to the presence of a fire in the area of said structure under said nozzle, each of said nozzles including means operable when such nozzle is actuated to discharge extinguishing fluid downwardly from said nozzle and to draw combustion gases from adjacent to said ceiling below said ceiling and project said combustion gases downwardly with said extinguishing fluid, the improvement wherein said system includes means to delay the discharge of extinguishing fluid from actuated nozzles until at least one ring of nozzles around a fire causing actuation of said nozzles have been actuated.

2. A fire extinguishment system as recited in claim 1, wherein said means to actuate such nozzle includes a heat sensitive element and comprises means responsive to the convective and radiative heat transferred from the hot combustion gases flowing past the heat sensing element of the nozzle.

3. A fire extinguishment system as recited in claim 1, further comprising a source of extinguishing fluid and connecting piping connected between said source of extinguishing fluid and said nozzles and wherein said means to delay the discharge of extinguishing fluid from actuated nozzles comprises a valve connected between said source of extinguishing fluid and said connecting piping and means to delay the opening of said valve sufficiently so that at least one ring of nozzles around a fire have been actuated by the time said extinguishment fluid reaches said nozzles from said valve.

4. A fire extinguishment system as recited in claim 3, wherein said valve and said connecting piping is a dry pipe system wherein said connecting piping contains gas under pressure and said valve opens in response to said gas under pressure dropping to a predetermined low value after the gas under pressure in said connecting piping drops to said predetermined low value in response to gas being bled from said connecting piping out through actuated nozzles.

5. A fire extinguishment system as recited in claim 1, wherein said nozzles each comprises a housing having an upper inlet opening and a lower discharge opening and an inner nozzle unit for spraying an extinguishing fluid downwardly within said housing.

6. A fire extinguishment system as recited in claim 5, wherein said extinguishing fluid comprises water, said nozzle units comprise fine spray nozzles producing water droplets in the range of 30 to 300 microns in diameter, said housing contains means to increase the residence time in said housing of the water sprayed by said inner nozzle unit into said housing so as to convert at least some of said water sprayed into said housing into steam.

7. A fire extinguishment system as recited in claim 6, wherein said means to increase the residence time of water in the housing comprises twirlers at the upper end of each of said nozzles and said housings.

8. A fire extinguishment system as recited in claim 1, wherein said means to delay the discharge of extinguishing fluid delays said discharge until at least two rings of nozzles around said fire have been actuated.

9. A method of fire extinguishment for extinguishing a fire within a structure having a ceiling and employing a plurality of nozzles distributed within said structure adjacent to said ceiling below said ceiling, said nozzles being of the aspiration type wherein each of said nozzles comprises means to spray extinguishing fluid downwardly and means to draw combustion gases from below said ceiling projected downwardly with said extinguishing fluid, comprising actuating nozzles only near the area of the fire in said structure in response to the presence of a fire and delaying the discharge of extinguishing fluid through actuated nozzles until at least one ring of nozzles around said fire have been actuated whereby an effective vortex of recirculating combustion gases is generated surrounding said fire to bar incoming air from reaching said fire.

10. A method as recited in claim 9, wherein said extinguishing fluid sprayed by actuated nozzles comprises water and further comprising converting said water to steam within said nozzles.

11. A method as recited in claim 9, wherein the discharge of extinguishing fluid is delayed until at least two rings of nozzles around said fire have been actuated.

* * * * *

UNITED STATES PATENT AND TRADEMARK OFFICE

CERTIFICATE OF CORRECTION

PATENT NO : 5,511,621

DATED : April 30, 1996

INVENTOR(S) : Yao

It is certified that error appears in the above-identified patent and that said Letters Patent is hereby corrected as shown below:

Title page item [73], "Factory Mutual research, Mass." should be --Factory Mutual Research, Mass.--

Column 6, line 1, delete lines 1-4, and insert the following --acceleration, $\gamma$ is the ratio of the specific heat at constant pressure to the specific heat at constant volume, R is the gas constant, $T_a$ is the temperature of the air in the connecting piping and $A_e$ is the discharge area of the open nozzles. By--

Column 6, line 56, change "(ft. sec.)$^{1/2}$" to --(ft. • sec.)$^{1/2}$--

Signed and Sealed this

Thirtieth Day of May, 2000

*Attest:*

*Attesting Officer*

Q. TODD DICKINSON

*Director of Patents and Trademarks*